US009776785B2

(12) United States Patent
Hanson et al.

(10) Patent No.: US 9,776,785 B2
(45) Date of Patent: Oct. 3, 2017

(54) CEILING TEXTURE MATERIALS, SYSTEMS, AND METHODS

(71) Applicant: Homax Products, Inc., Bellingham, WA (US)

(72) Inventors: Randal W. Hanson, Bellingham, WA (US); Carson Massie, Seattle, WA (US); Robert A. Kinzle, Polson, MT (US); Jane D. Wasley, Bellingham, WA (US); Scott Jackson, Avon, OH (US); David Bourlier, Bellingham, WA (US)

(73) Assignee: PPG Architectural Finishes, Inc., Pittsburgh, PA (US)

( * ) Notice: Subject to any disclaimer, the term of this patent is extended or adjusted under 35 U.S.C. 154(b) by 567 days.

(21) Appl. No.: 14/462,141

(22) Filed: Aug. 18, 2014

(65) Prior Publication Data

US 2015/0050425 A1 Feb. 19, 2015

Related U.S. Application Data

(60) Provisional application No. 61/867,524, filed on Aug. 19, 2013.

(51) Int. Cl.
*E04B 9/00* (2006.01)
*B65D 83/20* (2006.01)
(Continued)

(52) U.S. Cl.
CPC ..... *B65D 83/202* (2013.01); *B65D 83/206* (2013.01); *B65D 83/22* (2013.01);
(Continued)

(58) Field of Classification Search
None
See application file for complete search history.

(56) References Cited

U.S. PATENT DOCUMENTS 208,330 A 9/1878 Palmer
351,968 A 11/1886 Derrick
(Continued)

FOREIGN PATENT DOCUMENTS

CA 770467 10/1967
CA 976125 10/1975
(Continued)

OTHER PUBLICATIONS

Homax Products, Inc., "Easy Touch Spray Texture Brochure", Mar. 1992, 1 page.
(Continued)

*Primary Examiner* — Nathan T Leong
(74) *Attorney, Agent, or Firm* — Alan G. Towner

(57) ABSTRACT

An aerosol dispensing system has a container assembly, an actuator assembly, and a trigger member. The container assembly has a valve assembly. The actuator assembly has an actuator housing defining a rail portion, a trigger member pivotably attached to the actuator housing, and an outlet assembly defining an outlet opening. The outlet assembly is slidably supported relative to the actuator housing by the rail portion. The trigger member engages the outlet assembly such that application of deliberate manual force on the trigger member causes pivoting movement of the trigger member relative to the actuator housing and such that pivoting movement of the trigger member relative to the actuator housing causes linear movement of the outlet assembly relative to the actuator housing. The outlet assembly engages the valve assembly such that linear movement of the outlet assembly alters the valve assembly from a closed configuration to a fully open configuration.

24 Claims, 5 Drawing Sheets

(51) Int. Cl.

| | |
|---|---|
| ***B65D 83/14*** | (2006.01) |
| ***B65D 83/22*** | (2006.01) |
| ***B65D 83/32*** | (2006.01) |
| ***B65D 83/40*** | (2006.01) |

(52) U.S. Cl.

CPC ..... *B65D 83/32* (2013.01); *B65D 83/40* (2013.01); *B65D 83/752* (2013.01)

(56) References Cited

U.S. PATENT DOCUMENTS

| | | | |
|---|---|---|---|
| D25,916 | S | 8/1896 | Woods |
| 568,876 | A | 10/1896 | Regan |
| 579,418 | A | 3/1897 | Bookwalter |
| 582,397 | A | 5/1897 | Shone |
| 658,586 | A | 9/1900 | Reiling |
| 930,095 | A | 8/1909 | Seagrave |
| 931,757 | A | 8/1909 | Harmer |
| 941,671 | A | 11/1909 | Campbell |
| 1,093,907 | A | 4/1914 | Birnbaum |
| 1,154,974 | A | 9/1915 | Custer |
| 1,486,156 | A | 3/1924 | Needham |
| 2,127,188 | A | 8/1938 | Schellin et al. |
| 2,149,930 | A | 3/1939 | Plastaras |
| D134,562 | S | 12/1942 | Murphy |
| 2,307,014 | A | 1/1943 | Becker et al. |
| 2,320,964 | A | 6/1943 | Yates |
| 2,353,318 | A | 7/1944 | Scheller |
| 2,388,093 | A | 10/1945 | Smith |
| 2,530,808 | A | 11/1950 | Cerasi |
| 2,565,954 | A | 8/1951 | Dey |
| 2,612,293 | A | 9/1952 | Michel |
| 2,686,652 | A | 8/1954 | Carlson et al. |
| 2,723,200 | A | 11/1955 | Pyenson |
| 2,763,406 | A | 9/1956 | Countryman |
| 2,764,454 | A | 9/1956 | Edelstein |
| 2,785,926 | A | 3/1957 | Lataste |
| 2,790,680 | A | 4/1957 | Rosholt |
| 2,831,618 | A | 4/1958 | Soffer et al. |
| 2,839,225 | A | 6/1958 | Soffer et al. |
| 2,908,446 | A | 10/1959 | Strouse |
| 2,932,434 | A | 4/1960 | Abplanalp |
| 2,965,270 | A | 12/1960 | Soffer et al. |
| 2,968,441 | A | 1/1961 | Holcomb |
| 2,976,897 | A | 3/1961 | Beckworth |
| 2,997,243 | A | 8/1961 | Kolb |
| 3,083,872 | A | 4/1963 | Meshberg |
| 3,107,059 | A | 10/1963 | Frechette |
| 3,116,856 | A | 1/1964 | Prussin et al. |
| 3,148,806 | A | 9/1964 | Meshberg |
| 3,167,525 | A | 1/1965 | Thomas |
| 3,191,809 | A | 6/1965 | Schultz et al. |
| 3,196,819 | A | 7/1965 | Lechner et al. |
| 3,198,394 | A | 8/1965 | Lefer |
| 3,216,628 | A | 11/1965 | Fergusson |
| 3,246,850 | A | 4/1966 | Bourke |
| 3,258,208 | A | 6/1966 | Greenebaum, II |
| 3,284,007 | A | 11/1966 | Clapp |
| 3,305,144 | A | 2/1967 | Beres et al. |
| 3,314,571 | A | 4/1967 | Greenebaum, II |
| 3,317,140 | A | 5/1967 | Smith |
| 3,342,382 | A | 9/1967 | Huling |
| 3,346,195 | A | 10/1967 | Groth |
| 3,373,908 | A | 3/1968 | Crowell |
| 3,377,028 | A | 4/1968 | Bruggeman |
| 3,390,121 | A | 6/1968 | Burford |
| 3,405,845 | A | 10/1968 | Cook et al. |
| 3,414,171 | A | 12/1968 | Grisham et al. |
| 3,415,425 | A | 12/1968 | Knight et al. |
| 3,425,600 | A | 2/1969 | Abplanalp |
| 3,428,224 | A | 2/1969 | Eberhardt et al. |
| 3,433,391 | A | 3/1969 | Krizka et al. |
| 3,450,314 | A | 6/1969 | Gross |
| 3,467,283 | A | 9/1969 | Kinnavy |
| 3,472,457 | A | 10/1969 | McAvoy |
| 3,482,738 | A | 12/1969 | Bartels |
| 3,513,886 | A | 5/1970 | Easter et al. |
| 3,514,042 | A | 5/1970 | Freed |
| 3,544,258 | A | 12/1970 | Presant et al. |
| 3,548,564 | A | 12/1970 | Bruce et al. |
| 3,550,861 | A | 12/1970 | Teson |
| 3,575,319 | A | 4/1971 | Safianoff |
| 3,592,359 | A | 7/1971 | Marraffino |
| 3,596,835 | A | 8/1971 | Smith |
| 3,608,822 | A | 9/1971 | Berthoud |
| 3,613,954 | A | 10/1971 | Bayne |
| 3,648,932 | A | 3/1972 | Ewald et al. |
| 3,653,558 | A | 4/1972 | Shay |
| 3,698,645 | A | 10/1972 | Coffey |
| 3,700,136 | A | 10/1972 | Ruekberg |
| 3,703,994 | A | 11/1972 | Nigro |
| 3,704,811 | A | 12/1972 | Harden, Jr. |
| 3,704,831 | A | 12/1972 | Clark |
| 3,705,669 | A | 12/1972 | Cox et al. |
| 3,711,030 | A | 1/1973 | Jones |
| 3,764,067 | A | 10/1973 | Coffey et al. |
| 3,770,166 | A | 11/1973 | Marand |
| 3,773,706 | A | 11/1973 | Dunn, Jr. |
| 3,776,470 | A | 12/1973 | Tsuchiya |
| 3,776,702 | A | 12/1973 | Chant |
| 3,777,981 | A | 12/1973 | Probst et al. |
| 3,788,521 | A | 1/1974 | Laauwe |
| 3,795,366 | A | 3/1974 | McGhie et al. |
| 3,799,398 | A | 3/1974 | Morane et al. |
| 3,806,005 | A | 4/1974 | Prussin et al. |
| 3,811,369 | A | 5/1974 | Ruegg |
| 3,813,011 | A | 5/1974 | Harrison et al. |
| 3,814,326 | A | 6/1974 | Bartlett |
| 3,819,119 | A | 6/1974 | Coffey et al. |
| 3,828,977 | A | 8/1974 | Borchert |
| 3,848,778 | A | 11/1974 | Meshberg |
| 3,862,705 | A | 1/1975 | Beres et al. |
| 3,871,553 | A | 3/1975 | Steinberg |
| 3,891,128 | A | 6/1975 | Smrt |
| 3,912,132 | A | 10/1975 | Stevens |
| 3,913,803 | A | 10/1975 | Laauwe |
| 3,913,804 | A | 10/1975 | Laauwe |
| 3,913,842 | A | 10/1975 | Singer |
| 3,932,973 | A | 1/1976 | Moore |
| 3,936,002 | A | 2/1976 | Geberth, Jr. |
| 3,938,708 | A | 2/1976 | Burger |
| 3,975,554 | A | 8/1976 | Kummins et al. |
| 3,982,698 | A | 9/1976 | Anderson |
| 3,989,165 | A | 11/1976 | Shaw et al. |
| 3,991,916 | A | 11/1976 | Del Bon |
| 3,992,003 | A | 11/1976 | Visceglia et al. |
| 4,010,134 | A | 3/1977 | Braunisch et al. |
| 4,032,064 | A | 6/1977 | Giggard |
| 4,036,673 | A | 7/1977 | Murphy et al. |
| 4,045,860 | A | 9/1977 | Winckler |
| 4,089,443 | A | 5/1978 | Zrinyi |
| 4,096,974 | A | 6/1978 | Haber et al. |
| 4,117,951 | A | 10/1978 | Winckler |
| 4,129,448 | A | 12/1978 | Greenfield et al. |
| 4,147,284 | A | 4/1979 | Mizzi |
| 4,148,416 | A | 4/1979 | Gunn-Smith |
| 4,154,378 | A | 5/1979 | Paoletti et al. |
| 4,164,492 | A | 8/1979 | Cooper |
| RE30,093 | E | 9/1979 | Burger |
| 4,171,757 | A | 10/1979 | Diamond |
| 4,173,558 | A | 11/1979 | Beck |
| 4,185,758 | A | 1/1980 | Giggard |
| 4,187,959 | A | 2/1980 | Pelton |
| 4,187,985 | A | 2/1980 | Goth |
| 4,198,365 | A | 4/1980 | Pelton |
| 4,202,470 | A | 5/1980 | Fujii |
| 4,238,264 | A | 12/1980 | Pelton |
| 4,240,940 | A | 12/1980 | Vasishth et al. |
| 4,258,141 | A | 3/1981 | Jarre et al. |
| 4,275,172 | A | 6/1981 | Barth et al. |
| 4,293,353 | A | 10/1981 | Pelton et al. |
| 4,308,973 | A | 1/1982 | Irland |
| 4,310,108 | A | 1/1982 | Motoyama et al. |
| 4,322,020 | A | 3/1982 | Stone |

(56) References Cited

U.S. PATENT DOCUMENTS

| | | | |
|---|---|---|---|
| 4,346,743 | A | 8/1982 | Miller |
| 4,354,638 | A | 10/1982 | Weinstein |
| 4,358,388 | A | 11/1982 | Daniel et al. |
| 4,370,930 | A | 2/1983 | Strasser et al. |
| 4,372,475 | A | 2/1983 | Goforth et al. |
| 4,401,271 | A | 8/1983 | Hansen |
| 4,401,272 | A | 8/1983 | Merton et al. |
| 4,411,387 | A | 10/1983 | Stern et al. |
| 4,417,674 | A | 11/1983 | Giuffredi |
| 4,438,221 | A | 3/1984 | Fracalossi et al. |
| 4,442,959 | A | 4/1984 | Del Bon et al. |
| 4,460,719 | A | 7/1984 | Danville |
| 4,482,662 | A | 11/1984 | Rapaport et al. |
| 4,496,081 | A | 1/1985 | Farrey |
| 4,546,905 | A | 10/1985 | Nandagiri et al. |
| 4,595,127 | A | 6/1986 | Stoody |
| 4,609,608 | A | 9/1986 | Solc |
| 4,641,765 | A | 2/1987 | Diamond |
| 4,683,246 | A | 7/1987 | Davis et al. |
| 4,702,400 | A | 10/1987 | Corbett |
| 4,728,007 | A | 3/1988 | Samuelson et al. |
| 4,744,495 | A | 5/1988 | Warby |
| 4,761,312 | A | 8/1988 | Koshi et al. |
| 4,792,062 | A | 12/1988 | Goncalves |
| 4,793,162 | A | 12/1988 | Emmons |
| 4,804,144 | A | 2/1989 | Denman |
| 4,815,414 | A | 3/1989 | Duffy et al. |
| 4,819,838 | A | 4/1989 | Hart, Jr. |
| 4,830,224 | A | 5/1989 | Brison |
| 4,839,393 | A | 6/1989 | Buchanan et al. |
| 4,854,482 | A | 8/1989 | Bergner |
| 4,870,805 | A | 10/1989 | Morane |
| 4,878,599 | A | 11/1989 | Greenway |
| 4,887,651 | A | 12/1989 | Santiago |
| 4,893,730 | A | 1/1990 | Bolduc |
| 4,896,832 | A | 1/1990 | Howlett |
| D307,649 | S | 5/1990 | Henry |
| 4,940,171 | A | 7/1990 | Gilroy |
| 4,948,054 | A | 8/1990 | Mills |
| 4,949,871 | A | 8/1990 | Flanner |
| 4,951,876 | A | 8/1990 | Mills |
| 4,953,759 | A | 9/1990 | Schmidt |
| 4,954,544 | A | 9/1990 | Chandaria |
| 4,955,545 | A | 9/1990 | Stern et al. |
| 4,961,537 | A | 10/1990 | Stern |
| 4,969,577 | A | 11/1990 | Werding |
| 4,969,579 | A | 11/1990 | Behar |
| 4,988,017 | A | 1/1991 | Schrader et al. |
| 4,991,750 | A | 2/1991 | Moral |
| 5,007,556 | A | 4/1991 | Lover |
| 5,009,390 | A | 4/1991 | McAuliffe, Jr. et al. |
| 5,037,011 | A | 8/1991 | Woods |
| 5,038,964 | A | 8/1991 | Bouix |
| 5,052,585 | A | 10/1991 | Bolduc |
| 5,059,187 | A | 10/1991 | Sperry et al. |
| 5,065,900 | A | 11/1991 | Scheindel |
| 5,069,390 | A | 12/1991 | Stern et al. |
| 5,083,685 | A | 1/1992 | Amemiya et al. |
| 5,100,055 | A | 3/1992 | Rokitenetz et al. |
| 5,115,944 | A | 5/1992 | Nikolich |
| 5,126,086 | A | 6/1992 | Stoffel |
| 5,169,037 | A | 12/1992 | Davies et al. |
| 5,182,316 | A | 1/1993 | DeVoe et al. |
| 5,188,263 | A | 2/1993 | Woods |
| 5,188,295 | A | 2/1993 | Stern et al. |
| 5,211,317 | A | 5/1993 | Diamond et al. |
| 5,219,609 | A | 6/1993 | Owens |
| 5,250,599 | A | 10/1993 | Swartz |
| 5,277,336 | A | 1/1994 | Youel |
| 5,297,704 | A | 3/1994 | Stollmeyer |
| 5,307,964 | A | 5/1994 | Toth |
| 5,310,095 | A | 5/1994 | Stern et al. |
| 5,312,888 | A | 5/1994 | Nafziger et al. |
| 5,314,097 | A | 5/1994 | Smrt et al. |
| 5,323,963 | A | 6/1994 | Ballu |
| 5,341,970 | A | 8/1994 | Woods |
| 5,342,597 | A | 8/1994 | Tunison, III |
| 5,368,207 | A | 11/1994 | Cruysberghs |
| 5,374,434 | A | 12/1994 | Clapp et al. |
| 5,405,051 | A | 4/1995 | Miskell |
| 5,409,148 | A | 4/1995 | Stern et al. |
| 5,417,357 | A | 5/1995 | Yquel |
| D358,989 | S | 6/1995 | Woods |
| 5,421,519 | A | 6/1995 | Woods |
| 5,425,824 | A | 6/1995 | Marwick |
| 5,450,983 | A | 9/1995 | Stern et al. |
| 5,467,902 | A | 11/1995 | Yquel |
| 5,476,879 | A | 12/1995 | Woods et al. |
| 5,489,048 | A | 2/1996 | Stern et al. |
| 5,498,282 | A | 3/1996 | Miller et al. |
| 5,501,375 | A | 3/1996 | Nilson |
| 5,505,344 | A | 4/1996 | Woods |
| 5,523,798 | A | 6/1996 | Hagino et al. |
| 5,524,798 | A | 6/1996 | Stern et al. |
| 5,544,783 | A | 8/1996 | Conigliaro |
| 5,548,010 | A | 8/1996 | Franer |
| 5,549,228 | A | 8/1996 | Brown |
| 5,558,247 | A | 9/1996 | Caso |
| 5,562,235 | A | 10/1996 | Cruysberghs |
| 5,570,813 | A | 11/1996 | Clark, II |
| 5,573,137 | A | 11/1996 | Pauls |
| 5,583,178 | A | 12/1996 | Oxman et al. |
| 5,597,095 | A | 1/1997 | Ferrara, Jr. |
| 5,615,804 | A | 4/1997 | Brown |
| 5,639,026 | A | 6/1997 | Woods |
| 5,641,095 | A | 6/1997 | de Laforcade |
| 5,645,198 | A | 7/1997 | Stern et al. |
| 5,655,691 | A | 8/1997 | Stern et al. |
| 5,695,788 | A | 12/1997 | Woods |
| 5,715,975 | A | 2/1998 | Stern et al. |
| 5,727,736 | A | 3/1998 | Tryon |
| 5,752,631 | A | 5/1998 | Yabuno et al. |
| 5,775,432 | A | 7/1998 | Burns et al. |
| 5,792,465 | A | 8/1998 | Hagarty |
| 5,799,879 | A | 9/1998 | Ottl et al. |
| 5,865,351 | A | 2/1999 | De Laforcade |
| 5,868,286 | A | 2/1999 | Mascitelli |
| 5,887,756 | A | 3/1999 | Brown |
| 5,894,964 | A | 4/1999 | Barnes et al. |
| 5,915,598 | A | 6/1999 | Yazawa et al. |
| 5,921,446 | A | 7/1999 | Stern |
| 5,934,518 | A | 8/1999 | Stern et al. |
| 5,941,462 | A | 8/1999 | Sandor |
| 5,957,333 | A | 9/1999 | Losenno et al. |
| 5,975,356 | A | 11/1999 | Yquel et al. |
| 5,988,575 | A | 11/1999 | Lesko |
| 6,000,583 | A | 12/1999 | Stern et al. |
| 6,027,042 | A | 2/2000 | Smith |
| 6,032,830 | A | 3/2000 | Brown |
| 6,039,306 | A | 3/2000 | Pericard et al. |
| 6,062,494 | A | 5/2000 | Mills |
| 6,070,770 | A | 6/2000 | Tada et al. |
| 6,092,698 | A | 7/2000 | Bayer |
| 6,095,435 | A | 8/2000 | Greer, Jr. et al. |
| 6,112,945 | A | 9/2000 | Woods |
| 6,113,070 | A | 9/2000 | Holzboog |
| 6,116,473 | A | 9/2000 | Stern et al. |
| 6,129,247 | A | 10/2000 | Thomas et al. |
| 6,131,777 | A | 10/2000 | Warby |
| 6,139,821 | A | 10/2000 | Fuerst et al. |
| 6,152,335 | A | 11/2000 | Stern et al. |
| 6,161,735 | A | 12/2000 | Uchiyama et al. |
| 6,168,093 | B1 | 1/2001 | Greer, Jr. et al. |
| 6,170,717 | B1 | 1/2001 | Di Giovanni et al. |
| D438,111 | S | 2/2001 | Woods |
| D438,786 | S | 3/2001 | Ghali |
| 6,225,393 | B1 | 5/2001 | Woods |
| 6,254,015 | B1 | 7/2001 | Abplanalp |
| 6,257,503 | B1 | 7/2001 | Baudin |
| 6,261,631 | B1 | 7/2001 | Lomasney et al. |
| 6,265,459 | B1 | 7/2001 | Mahoney et al. |
| 6,276,570 | B1 | 8/2001 | Stern et al. |
| 6,283,171 | B1 | 9/2001 | Blake |
| 6,284,077 | B1 | 9/2001 | Lucas et al. |

(56) References Cited

U.S. PATENT DOCUMENTS

| | | | |
|---|---|---|---|
| 6,290,104 | B1 | 9/2001 | Bougamont et al. |
| 6,291,536 | B1 | 9/2001 | Taylor |
| 6,296,155 | B1 | 10/2001 | Smith |
| 6,296,156 | B1 | 10/2001 | Lasserre et al. |
| 6,299,679 | B1 | 10/2001 | Montoya |
| 6,299,686 | B1 | 10/2001 | Mills |
| 6,315,152 | B1 | 11/2001 | Kalisz |
| 6,325,256 | B1 | 12/2001 | Liljeqvist et al. |
| 6,328,185 | B1 | 12/2001 | Stern et al. |
| 6,328,197 | B1 | 12/2001 | Gapihan |
| 6,333,365 | B1 | 12/2001 | Lucas et al. |
| 6,352,184 | B1 | 3/2002 | Stern et al. |
| 6,362,302 | B1 | 3/2002 | Boddie |
| 6,375,036 | B1 | 4/2002 | Woods |
| 6,382,474 | B1 | 5/2002 | Woods et al. |
| 6,386,402 | B1 | 5/2002 | Woods |
| 6,394,321 | B1 | 5/2002 | Bayer |
| 6,394,364 | B1 | 5/2002 | Abplanalp |
| 6,395,794 | B2 | 5/2002 | Lucas et al. |
| 6,398,082 | B2 | 6/2002 | Clark et al. |
| 6,399,687 | B2 | 6/2002 | Woods |
| 6,414,044 | B2 | 7/2002 | Taylor |
| 6,415,964 | B2 | 7/2002 | Woods |
| 6,439,430 | B1 | 8/2002 | Gilroy, Sr. et al. |
| 6,446,842 | B2 | 9/2002 | Stern et al. |
| D464,395 | S | 10/2002 | Huang |
| 6,474,513 | B2 | 11/2002 | Burt |
| 6,478,198 | B2 | 11/2002 | Haroian |
| 6,478,561 | B2 | 11/2002 | Braun et al. |
| 6,482,392 | B1 | 11/2002 | Zhou et al. |
| D468,980 | S | 1/2003 | Woods |
| 6,510,969 | B2 | 1/2003 | Di Giovanni et al. |
| 6,520,377 | B2 | 2/2003 | Yquel |
| 6,531,528 | B1 | 3/2003 | Kurp |
| 6,536,633 | B2 | 3/2003 | Stern et al. |
| 6,581,807 | B1 | 6/2003 | Mekata |
| 6,588,628 | B2 | 7/2003 | Abplanalp et al. |
| 6,595,393 | B1 | 7/2003 | Loghman-Adham et al. |
| 6,613,186 | B2 | 9/2003 | Johnson |
| 6,615,827 | B2 | 9/2003 | Greenwood et al. |
| 6,637,627 | B1 | 10/2003 | Liljeqvist et al. |
| 6,641,005 | B1 | 11/2003 | Stern et al. |
| 6,641,864 | B2 | 11/2003 | Woods |
| 6,652,704 | B2 | 11/2003 | Green |
| 6,659,312 | B1 | 12/2003 | Stern et al. |
| 6,666,352 | B1 | 12/2003 | Woods |
| 6,688,492 | B2 | 2/2004 | Jaworski et al. |
| 6,712,238 | B1 | 3/2004 | Mills |
| 6,726,066 | B2 | 4/2004 | Woods |
| 6,736,288 | B1 | 5/2004 | Green |
| 6,758,373 | B2 | 7/2004 | Jackson et al. |
| 6,797,051 | B2 | 9/2004 | Woods |
| 6,802,461 | B2 | 10/2004 | Schneider |
| 6,831,110 | B2 | 12/2004 | Ingold et al. |
| 6,832,704 | B2 | 12/2004 | Smith |
| 6,837,396 | B2 | 1/2005 | Jaworski et al. |
| 6,843,392 | B1 | 1/2005 | Walker |
| D501,538 | S | 2/2005 | Zeng |
| D501,914 | S | 2/2005 | Chen |
| 6,848,601 | B2 | 2/2005 | Greer, Jr. |
| 6,851,575 | B2 | 2/2005 | van't Hoff |
| D502,533 | S | 3/2005 | Chen |
| 6,880,733 | B2 | 4/2005 | Park |
| 6,883,688 | B1 | 4/2005 | Stern et al. |
| 6,894,095 | B2 | 5/2005 | Russo et al. |
| 6,905,050 | B1 | 6/2005 | Stern et al. |
| 6,910,608 | B2 | 6/2005 | Greer, Jr. et al. |
| 6,913,407 | B2 | 7/2005 | Greer et al. |
| 6,926,178 | B1 | 8/2005 | Anderson |
| 6,929,154 | B2 | 8/2005 | Grey et al. |
| 6,932,244 | B2 | 8/2005 | Meshberg |
| 6,966,567 | B2 | 11/2005 | Di Giovanni et al |
| D512,309 | S | 12/2005 | Geier |
| 6,971,353 | B2 | 12/2005 | Heinze et al. |
| 6,971,553 | B2 | 12/2005 | Brennan et al. |
| 6,978,916 | B2 | 12/2005 | Smith |
| 6,978,947 | B2 | 12/2005 | Jin |
| 6,981,616 | B2 | 1/2006 | Loghman-Adham et al. |
| 7,014,073 | B1 | 3/2006 | Stern et al. |
| 7,014,127 | B2 | 3/2006 | Valpey, III et al. |
| 7,036,685 | B1 | 5/2006 | Green |
| 7,045,008 | B2 | 5/2006 | Langford |
| 7,059,497 | B2 | 6/2006 | Woods |
| 7,059,546 | B2 | 6/2006 | Ogata et al. |
| 7,063,236 | B2 | 6/2006 | Greer, Jr. et al. |
| 7,104,424 | B2 | 9/2006 | Kolanus |
| 7,104,427 | B2 | 9/2006 | Pericard |
| 7,121,434 | B1 | 10/2006 | Caruso |
| 7,163,962 | B2 | 1/2007 | Woods |
| 7,182,227 | B2 | 2/2007 | Poile et al. |
| 7,189,022 | B1 | 3/2007 | Greer, Jr. et al. |
| 7,192,985 | B2 | 3/2007 | Woods |
| 7,204,393 | B2 | 4/2007 | Strand |
| 7,226,001 | B1 | 6/2007 | Stern et al. |
| 7,226,232 | B2 | 6/2007 | Greer, Jr. et al. |
| 7,232,047 | B2 | 6/2007 | Greer, Jr. et al. |
| 7,237,697 | B2 | 7/2007 | Dunne |
| 7,240,857 | B1 | 7/2007 | Stern et al. |
| 7,249,692 | B2 | 7/2007 | Walters et al. |
| 7,261,225 | B2 | 8/2007 | Rueschhoff et al. |
| 7,267,248 | B2 | 9/2007 | Yerby et al. |
| 7,278,590 | B1 | 10/2007 | Greer, Jr. et al. |
| 7,303,152 | B2 | 12/2007 | Woods |
| 7,307,053 | B2 | 12/2007 | Tasz et al. |
| 7,337,985 | B1 | 3/2008 | Greer, Jr. et al. |
| 7,341,169 | B2 | 3/2008 | Bayer |
| 7,350,676 | B2 | 4/2008 | Di Giovanni et al. |
| 7,374,068 | B2 | 5/2008 | Greer, Jr. |
| 7,383,968 | B2 | 6/2008 | Greer, Jr. et al. |
| 7,383,970 | B2 | 6/2008 | Anderson |
| 7,445,166 | B2 | 11/2008 | Williams |
| 7,448,517 | B2 | 11/2008 | Shieh et al. |
| 7,481,338 | B1 | 1/2009 | Stern et al. |
| 7,487,891 | B2 | 2/2009 | Yerby et al. |
| 7,487,893 | B1 | 2/2009 | Greer, Jr. et al. |
| 7,494,075 | B2 | 2/2009 | Schneider |
| 7,500,621 | B2 | 3/2009 | Tryon et al. |
| 7,510,102 | B2 | 3/2009 | Schmitt |
| 7,556,841 | B2 | 7/2009 | Kimball et al. |
| D600,119 | S | 9/2009 | Sweeton |
| 7,588,171 | B2 | 9/2009 | Reedy et al. |
| 7,597,274 | B1 | 10/2009 | Stern et al. |
| 7,600,659 | B1 | 10/2009 | Greer, Jr. et al. |
| 7,624,932 | B1 | 12/2009 | Greer, Jr. et al. |
| 7,631,785 | B2 | 12/2009 | Paas et al. |
| 7,641,079 | B2 | 1/2010 | Lott et al. |
| 7,673,816 | B1 | 3/2010 | Stern et al. |
| 7,677,420 | B1 | 3/2010 | Greer, Jr. et al. |
| 7,699,190 | B2 | 4/2010 | Hygema |
| 7,721,920 | B2 | 5/2010 | Ruiz De Gopegui et al. |
| 7,744,299 | B1 | 6/2010 | Greer, Jr. et al. |
| 7,748,572 | B2 | 7/2010 | Althoff et al. |
| 7,757,905 | B2 | 7/2010 | Strand et al. |
| 7,766,196 | B2 | 8/2010 | Sugano et al. |
| 7,775,408 | B2 | 8/2010 | Yamamoto et al. |
| 7,784,647 | B2 | 8/2010 | Tourigny |
| 7,784,649 | B2 | 8/2010 | Greer, Jr. |
| 7,789,278 | B2 | 9/2010 | Ruiz de Gopegui et al. |
| 7,845,523 | B1 | 12/2010 | Greer, Jr. et al. |
| 7,854,356 | B2 | 12/2010 | Eberhardt |
| 7,861,894 | B2 | 1/2011 | Walters et al. |
| 7,886,995 | B2 | 2/2011 | Togashi |
| 7,891,529 | B2 | 2/2011 | Paas et al. |
| 7,913,877 | B2 | 3/2011 | Neuhalfen |
| 7,922,041 | B2 | 4/2011 | Gurrisi et al. |
| 7,926,741 | B2 | 4/2011 | Laidler et al. |
| 7,947,753 | B2 | 5/2011 | Greer, Jr. |
| 7,971,800 | B2 | 7/2011 | Combs et al. |
| 7,980,487 | B2 | 7/2011 | Mirazita et al. |
| 7,984,827 | B2 | 7/2011 | Hygema |
| 7,984,834 | B2 | 7/2011 | McBroom et al. |
| 7,997,511 | B2 | 8/2011 | Reynolds et al. |
| 8,006,868 | B2 | 8/2011 | Geiberger et al. |
| 8,016,163 | B2 | 9/2011 | Behar et al. |

(56) References Cited

U.S. PATENT DOCUMENTS 8,025,189 B2 9/2011 Salameh
8,028,861 B2 10/2011 Brouwer
8,028,864 B2 10/2011 Stern et al.
8,033,432 B2 10/2011 Pardonge et al.
8,033,484 B2 10/2011 Tryon et al.
8,038,077 B1 10/2011 Greer, Jr. et al.
8,042,713 B2 10/2011 Greer, Jr. et al.
8,070,017 B2 12/2011 Green
8,074,847 B2 12/2011 Smith
8,074,848 B2 12/2011 Pittl et al.
8,083,159 B2 12/2011 Leuliet et al.
8,087,548 B2 1/2012 Kimball
8,087,552 B2 1/2012 Fazekas et al.
8,128,008 B2 3/2012 Chevalier
8,132,697 B2 3/2012 Finlay et al.
8,146,782 B2 4/2012 Gross et al.
8,157,135 B2 4/2012 Stern et al.
8,172,113 B2 5/2012 Greer, Jr.
8,187,574 B2 5/2012 Mekata et al.
D661,580 S 6/2012 Takizawa et al.
8,191,739 B1 6/2012 Cash et al.
8,196,783 B2 6/2012 Krzecki
8,201,757 B2 6/2012 Suzuki
8,215,862 B2 7/2012 Greer, Jr. et al.
8,217,091 B2 7/2012 Vijayakumar
8,221,019 B2 7/2012 Greer, Jr. et al.
8,240,523 B2 8/2012 Goulet
8,251,255 B1 8/2012 Greer, Jr. et al.
8,267,286 B2 9/2012 Smrt et al.
8,276,832 B2 10/2012 Nelson et al.
8,281,958 B2 10/2012 Mathews et al.
8,286,839 B2 10/2012 Jasper
8,313,011 B2 11/2012 Greer, Jr. et al.
8,317,065 B2 11/2012 Stern et al.
8,328,053 B2 12/2012 Bargo
8,328,120 B2 12/2012 Vanblaere et al.
8,333,304 B1 12/2012 Haage
8,336,742 B2 12/2012 Greer, Jr. et al.
8,342,421 B2 1/2013 Greer, Jr. et al.
8,344,056 B1 1/2013 Tait et al.
8,353,465 B2 1/2013 Tryon et al.
8,356,734 B2 1/2013 Oshimo et al.
8,360,280 B2 1/2013 Tournier
8,371,481 B2 2/2013 Kopp
8,393,554 B2 3/2013 Yamamoto et al.
8,420,705 B2 4/2013 Greer, Jr.
8,444,026 B2 5/2013 Adams et al.
8,469,292 B1 6/2013 Hanson et al.
8,505,786 B2 8/2013 Stern et al.
8,551,572 B1 10/2013 Tait et al.
8,561,840 B2 10/2013 Greer, Jr. et al.
8,573,451 B2 11/2013 Tryon
8,580,349 B1 11/2013 Kordosh et al.
8,584,898 B2 11/2013 Greer, Jr. et al.
8,622,255 B2 1/2014 Greer, Jr.
8,647,006 B2 2/2014 Greer, Jr. et al.
8,701,944 B2 4/2014 Tryon
8,784,942 B2 7/2014 Tait et al.
8,820,656 B2 9/2014 Tryon et al.
8,840,038 B2 9/2014 Lehr
8,844,765 B2 9/2014 Tryon
8,883,902 B2 11/2014 Tait et al.
8,887,953 B2 11/2014 Greer, Jr. et al.
D718,624 S 12/2014 Hanson
2001/0002676 A1 6/2001 Woods
2002/0003147 A1 1/2002 Corba
2002/0100769 A1 8/2002 Mckune
2002/0119256 A1 8/2002 Woods
2003/0102328 A1 6/2003 Abplanalp et al.
2003/0134973 A1 7/2003 Chen et al.
2003/0205580 A1 11/2003 Yahav
2004/0012622 A1 1/2004 Russo et al.
2004/0099697 A1 5/2004 Woods
2004/0141797 A1 7/2004 Garabedian et al.
2004/0154264 A1 8/2004 Colbert
2004/0157960 A1 8/2004 Rowe
2004/0195277 A1 10/2004 Woods
2005/0121474 A1 6/2005 Lasserre et al.
2005/0236436 A1 10/2005 Woods
2005/0256257 A1 11/2005 Betremieux et al.
2006/0049205 A1 3/2006 Green
2006/0180616 A1 8/2006 Woods
2006/0219808 A1 10/2006 Woods
2006/0219811 A1 10/2006 Woods
2006/0273207 A1 12/2006 Woods
2007/0117916 A1 5/2007 Anderson et al.
2007/0119984 A1 5/2007 Woods
2007/0125879 A1 6/2007 Khamenian
2007/0142260 A1 6/2007 Tasz et al.
2007/0155892 A1 7/2007 Gharapetian et al.
2007/0178243 A1 8/2007 Houck et al.
2007/0194040 A1 8/2007 Tasz et al.
2007/0219310 A1 9/2007 Woods
2007/0228086 A1 10/2007 Delande et al.
2007/0260011 A1 11/2007 Woods
2007/0272765 A1 11/2007 Kwasny
2007/0272768 A1 11/2007 Williams et al.
2008/0008678 A1 1/2008 Wyers
2008/0029551 A1 2/2008 Lombardi
2008/0033099 A1 2/2008 Bosway
2008/0041887 A1 2/2008 Scheindel
2009/0020621 A1 1/2009 Clark et al.
2010/0108716 A1 5/2010 Bilko
2010/0155432 A1 6/2010 Christianson
2010/0322892 A1 12/2010 Burke
2011/0021675 A1 1/2011 Shigemori et al.
2011/0101025 A1 5/2011 Walters et al.
2011/0127300 A1 6/2011 Ghavami-Nasr et al.
2011/0210141 A1 9/2011 Maas et al.
2011/0210184 A1 9/2011 Maas et al.
2011/0215119 A1 9/2011 McBroom
2011/0218096 A1 9/2011 Hatanaka et al.
2011/0220685 A1 9/2011 Lind et al.
2011/0240682 A1 10/2011 Miyamoto et al.
2011/0240771 A1 10/2011 Legeza
2011/0253749 A1 10/2011 Hygema
2011/0266310 A1 11/2011 Tomkins et al.
2012/0000930 A1 1/2012 Barbieri
2012/0000931 A1 1/2012 Cabiri et al.
2012/0006858 A1 1/2012 Rovelli
2012/0006859 A1 1/2012 Wilkinson et al.
2012/0032000 A1 2/2012 Brunk et al.
2012/0043353 A1 2/2012 Davideit et al.
2012/0048959 A1 3/2012 Maas et al.
2012/0064249 A1 3/2012 Greer, Jr. et al.
2012/0097713 A1 4/2012 MacKinnon et al.
2012/0132670 A1 5/2012 Finlay et al.
2012/0168460 A1 7/2012 Tolstykh
2012/0168463 A1 7/2012 Hanai et al.
2012/0181300 A1 7/2012 Maxa et al.
2012/0211513 A1 8/2012 Alfaro et al.
2012/0228336 A1 9/2012 Davideit et al.
2012/0234947 A1 9/2012 Takahashi
2012/0241457 A1 9/2012 Hallman et al.
2012/0261439 A1 10/2012 Dennis et al.
2012/0312896 A1 12/2012 Thurin et al.
2012/0318830 A1 12/2012 Lim
2013/0008981 A1 1/2013 Bloc et al.
2013/0022747 A1 1/2013 Greer, Jr. et al.
2013/0026252 A1* 1/2013 Hanson ..... B05B 1/30
239/325
2013/0026253 A1 1/2013 Hanson et al.
2013/0037580 A1 2/2013 Armstrong et al.
2013/0037582 A1 2/2013 Anderson
2013/0102696 A1 4/2013 Greer, Jr. et al.
2013/0112766 A1 5/2013 Maas et al.
2013/0122200 A1 5/2013 Greer, Jr. et al.
2013/0230655 A1 9/2013 Greer, Jr.
2014/0050853 A1 2/2014 Greer, Jr. et al.
2014/0061335 A1 3/2014 Tryon
2014/0072714 A1 3/2014 Kordosh et al.
2014/0079882 A1 3/2014 Greer, Jr. et al.
2014/0113076 A1 4/2014 Greer, Jr. et al.
2014/0120260 A1 5/2014 Greer, Jr.

(56) References Cited

U.S. PATENT DOCUMENTS

| | | | |
|---|---|---|---|
| 2014/0162023 | A1 | 6/2014 | Greer, Jr. et al. |
| 2014/0248428 | A1 | 9/2014 | Tryon |
| 2014/0249256 | A1 | 9/2014 | Kordosh |
| 2014/0263417 | A1 | 9/2014 | Hanson et al. |
| 2014/0272124 | A1 | 9/2014 | Kordosh et al. |
| 2014/0272140 | A1 | 9/2014 | Hanson et al. |
| 2014/0335278 | A1 | 11/2014 | Tait et al. |
| 2014/0367410 | A1 | 12/2014 | Tryon et al. |

FOREIGN PATENT DOCUMENTS

| | | |
|---|---|---|
| CA | 1191493 | 8/1985 |
| CA | 1210371 | 8/1986 |
| CA | 2145129 | 9/1995 |
| CA | 2090185 | 10/1998 |
| CA | 2224042 | 6/1999 |
| CA | 2291599 | 6/2000 |
| CA | 2381994 | 2/2001 |
| CA | 2327903 | 6/2001 |
| CA | 2065534 | 8/2003 |
| CA | 2448794 | 5/2004 |
| CA | 2504509 | 10/2005 |
| CA | 2504513 | 10/2005 |
| CA | 2533964 | 7/2006 |
| CH | 680849 | 11/1992 |
| DE | 1926796 | 3/1970 |
| DE | 3808438 | 4/1989 |
| DE | 3806991 | 9/1989 |
| EP | 2130788 | 12/2009 |
| FR | 463476 | 2/1914 |
| FR | 84727 | 9/1965 |
| FR | 1586067 | 12/1969 |
| FR | 2659847 | 9/1991 |
| GB | 867713 | 5/1961 |
| GB | 970766 | 9/1964 |
| GB | 977860 | 12/1964 |
| GB | 1144385 | 3/1969 |
| GB | 2418959 | 4/2006 |
| JP | 461392 | 1/1971 |
| JP | 55142073 | 11/1980 |
| JP | 8332414 | 12/1996 |
| WO | 9418094 | 8/1994 |
| WO | 2005087617 | 9/2005 |
| WO | 2005108240 | 11/2005 |
| WO | 2006090229 | 8/2006 |
| WO | 2008060157 | 5/2008 |
| WO | 2013019683 | 2/2013 |
| WO | 2014144671 | 9/2014 |
| WO | 2014165237 | 10/2014 |

OTHER PUBLICATIONS

Newman-Green, Inc., "Aerosol Valves, Sprayheads & Accessories Catalog", Apr. 1, 1992, pp. 14, 20, and 22.

ATSM, "Standard Test Method for Conducting Cyclic Potentiodynamic Polarization Measurements for Localized Corrosion Susceptibility of Iron-Nickel, or Cobalt-Based Alloys," 1993, 5 pages.

Tait, "An Introduction to Electrochemical Corrosion Testing for Practicing Engineers and Scientists," 1994, 17 pages.

Chadwick, "Controlling Particle Size in Self-Pressurized Aerosol Packages," Metal Finishing, Jul./Aug. 2004, 3 pages, vol. 102, No. 7/8.

Hazelton, "How to Refinish a Kitchen Table," http://www.ronhazelton.com/projects/how_to_refinish_a_kitchen_table, Sep. 23, 2011, 5 pages.

Homax, "Pro Grade Wall Textures," http://orders.homaxproducts.com/Pro-Grade-Wall-Textures, 2013, 1 page.

* cited by examiner

CEILING TEXTURE MATERIALS, SYSTEMS, AND METHODS

RELATED APPLICATIONS

This application claims benefit of U.S. Provisional Application Ser. No. 61/867,524 filed Aug. 19, 2013, the contents of which are incorporated herein by reference.

TECHNICAL FIELD

The present invention relates to aerosol systems and methods for dispensing texture material and, more specifically, aerosol systems and methods configured to dispense texture material onto ceiling surfaces.

BACKGROUND

Texture material is applied to interior surfaces of structures, including ceiling surfaces. In new construction, the texture material is applied by a hopper gun. When texture material on a target surface or the target surface itself is damaged, a new coating of texture material is applied. For small repairs, the use of a hopper gun is not practical, and acoustic texture material is applied using an aerosol dispenser.

The need exists for improved aerosol dispensing systems and methods configured to apply texture material to a target surface when the target surface is a ceiling surface.

SUMMARY

The present invention may be embodied as an aerosol dispensing system for dispensing texture material onto a ceiling surface comprising a container assembly, an actuator assembly, and a trigger member. The container assembly comprises a valve assembly operable in a closed configuration and a fully open configuration. The actuator assembly comprises an actuator housing defining at least one rail portion, a trigger member pivotably attached to the actuator housing, and an outlet assembly defining an outlet opening, where the outlet assembly is slidably supported relative to the actuator housing by the at least one rail portion. The trigger member engages the outlet assembly such that application of deliberate manual force on the trigger member causes pivoting movement of the trigger member relative to the actuator housing and such that pivoting movement of the trigger member relative to the actuator housing causes linear movement of the outlet assembly relative to the actuator housing. The outlet assembly engages the valve assembly such that linear movement of the outlet assembly alters the valve assembly from the closed configuration to the fully open configuration.

The present invention may also be embodied as a method of dispensing texture material onto a ceiling surface comprising the following steps. A container assembly comprising a valve assembly is provided. The valve assembly is operable in a closed configuration and a fully open configuration. An actuator housing defining at least one rail portion is provided. A trigger member is provided. An outlet assembly defining an outlet opening is provided. An actuator assembly is formed by pivotably attaching the trigger member to the actuator housing, slidably supporting the outlet assembly relative to the actuator housing by the at least one rail portion, and engaging the trigger member with the outlet assembly such that application of deliberate manual force on the trigger member causes pivoting movement of the trigger member relative to the actuator housing and pivoting movement of the trigger member relative to the actuator housing causes linear movement of the outlet assembly relative to the actuator housing. The outlet assembly is engaged with the valve assembly such that linear movement of the outlet assembly alters the valve assembly from the closed configuration to the fully open configuration. Deliberate manual force is applied on the trigger member to open the valve assembly.

The present invention may also be embodied as a method of dispensing texture material onto a ceiling surface comprising the following steps. A container assembly comprising a valve assembly is provided. The valve assembly is operable in a closed configuration and a fully open configuration. An actuator housing defining at least one rail portion is provided. A trigger member is provided. An outlet assembly defining an outlet opening is provided. An actuator assembly is formed by pivotably attaching the trigger member to the actuator housing, slidably supporting the outlet assembly relative to the actuator housing by the at least one rail portion, and engaging the trigger member with the outlet assembly such that application of deliberate manual force on the trigger member causes pivoting movement of the trigger member relative to the actuator housing and pivoting movement of the trigger member relative to the actuator housing causes linear movement of the outlet assembly relative to the actuator housing. The outlet assembly is engaged with the valve assembly such that linear movement of the outlet assembly alters the valve assembly from the closed configuration to the fully open configuration. Deliberate manual force is applied on the trigger member to open the valve assembly.

DETAILED DESCRIPTION

Figure 1:
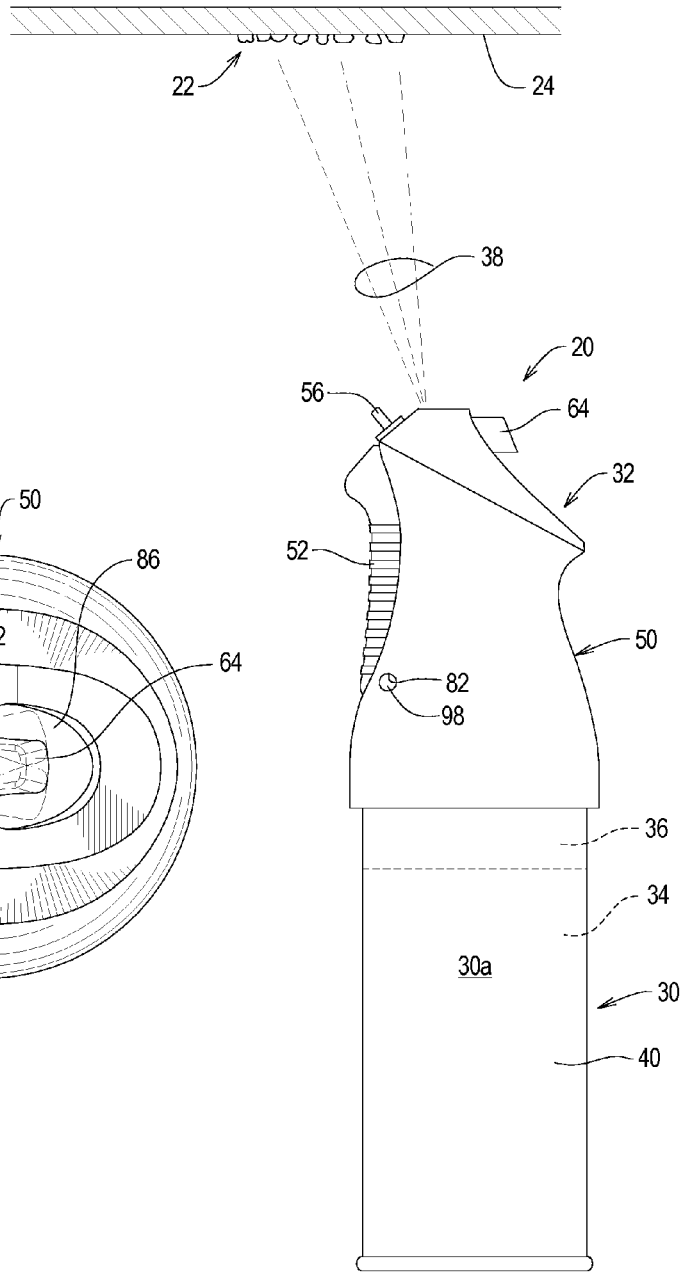
FIG. 1 is a side elevation view of a first example aerosol dispensing system of the present invention being used to apply texture material to a ceiling surface.
Figure 2:
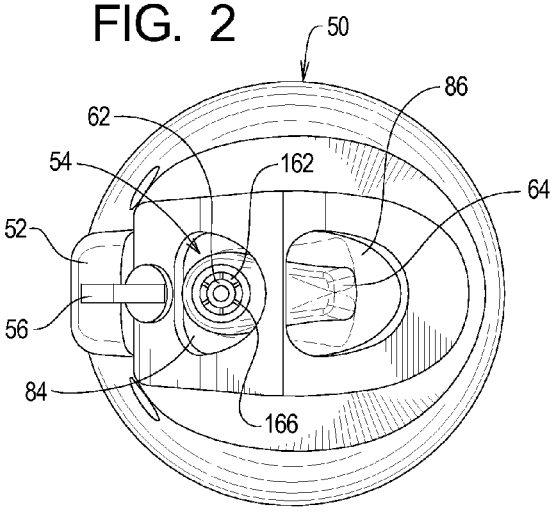
FIG. 2 is a top plan view of the first example aerosol dispensing system of the present invention.

FIG. 1 illustrates a first example aerosol dispensing system 20 that is constructed in accordance with, and embodies, the principles of the present invention. As shown in FIG. 1, the first example aerosol dispensing system 20 is configured to form a texture coating 22 on a target surface 24. The example target surface is a downward facing, horizontal surface such as a ceiling surface.

The first example aerosol dispensing system 20 comprises a container assembly 30 and an actuator assembly 32. Contained within the first example aerosol dispensing system 20 are a texture material 34 and a propellant material 36. The container assembly 30 supports the actuator assembly 32 such that the actuator assembly 32 is operable to dispense the texture material 34 in a spray 38 to form the texture coating 22. Because the example target surface is a ceiling surface, the first example aerosol dispensing system 20 is configured to direct the spray 38 of texture material 34 upwardly when the example aerosol dispensing system 20 is in a generally vertical orientation as shown in FIG. 1.

The propellant material 36 may be a compressed inert gas such as air or nitrogen that pressurizes the texture material 34. More commonly, however, the propellant material is formed by a material that exists in both liquid and gas forms within the container assembly 30. The portion of the propellant material 36 in gas state pressurizes the texture material 34 such that at least a portion of the texture material 34 is forced out of the aerosol assembly 20 when the valve assembly 44 is opened as described elsewhere herein. As the volume of texture material 34 within the container assembly 30 decreases, the portion of the propellant material 36 is liquid form gasifies to rebuild pressure within the container assembly 30.

The example container assembly 30 comprises a container 40, a cap assembly 42, a valve assembly 44, a valve stem 46, and a dip tube 48. The example actuator assembly 32 comprises an actuator housing 50, trigger member 52, outlet assembly 54, and lock member 56. The example outlet assembly 54 comprises an outlet member 60, a resilient member 62, and an adjustment member 64.

In general, the valve assembly 44 is operable in a normally closed configuration and an open configuration. In the closed configuration, fluid is substantially prevented from flowing out of the example aerosol dispensing system 20. In the open configuration, the propellant material 36 forces the texture material 34 out of the example aerosol dispensing system 20 through the outlet member 60 and the resilient member 62 in the spray 38.

More specifically, the cap assembly 42 is secured to the container 40 and supports the valve assembly 44 to define a substantially fluid-tight container chamber 30*a*. The texture material 34 and the propellant material 36 are stored within the container chamber 30*a*. The valve stem 46 extends from or forms a part of the valve assembly 44 such that displacing the valve stem 46 towards the valve assembly 44 places the valve assembly 44 in the open configuration. The valve stem 46 may be integrally formed with the outlet member 60 in another configuration of the present invention. The example actuator housing 50 is detachably attached to the container assembly 30. The outlet member 60 supports the resilient member 62 and the adjustment member 64 to form the outlet assembly 54.

Figure 3:
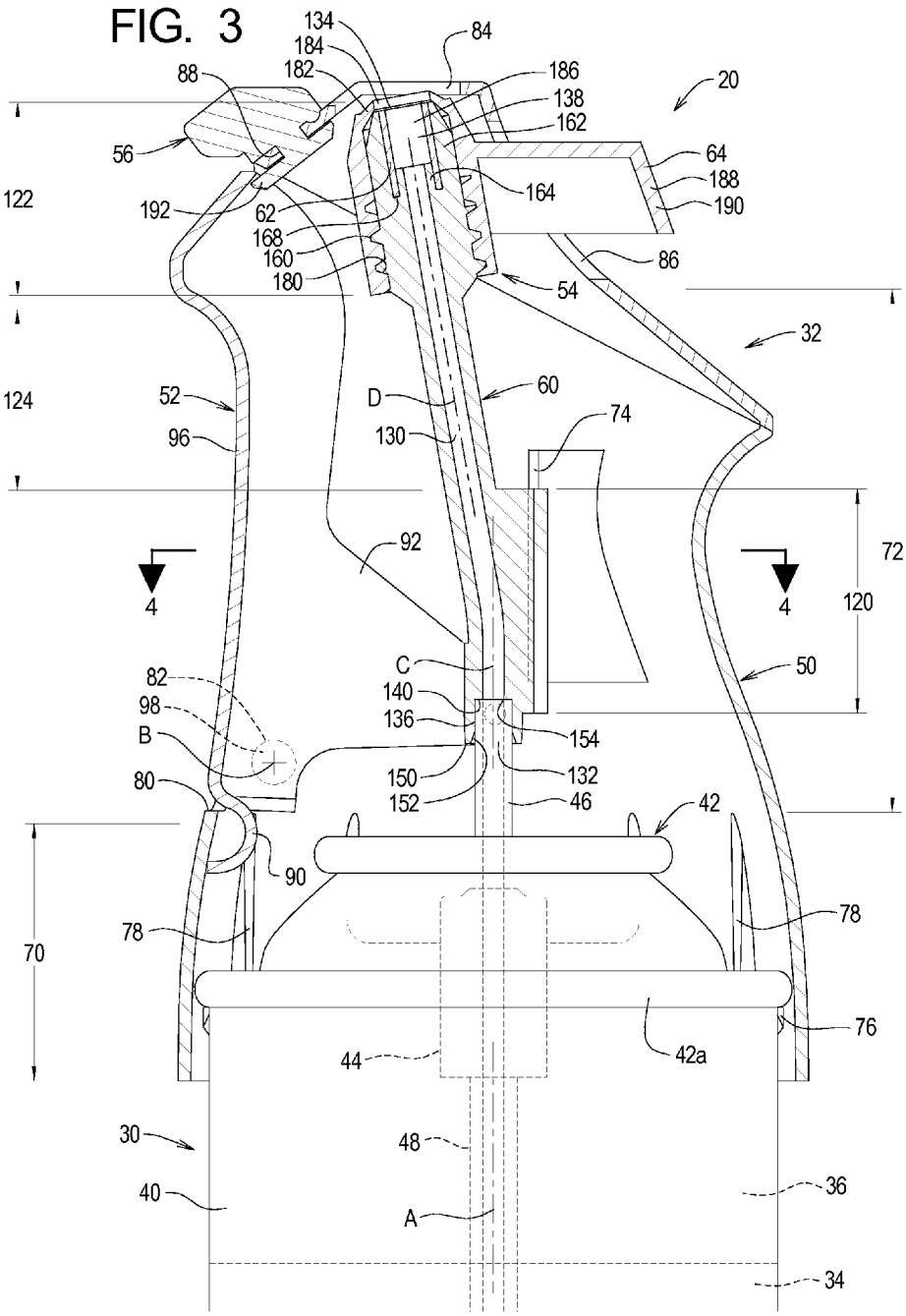
FIG. 3 is a side elevation, vertical, partial cutaway view of an example actuator assembly of the first example aerosol dispensing system in a closed configuration.
Figure 7:
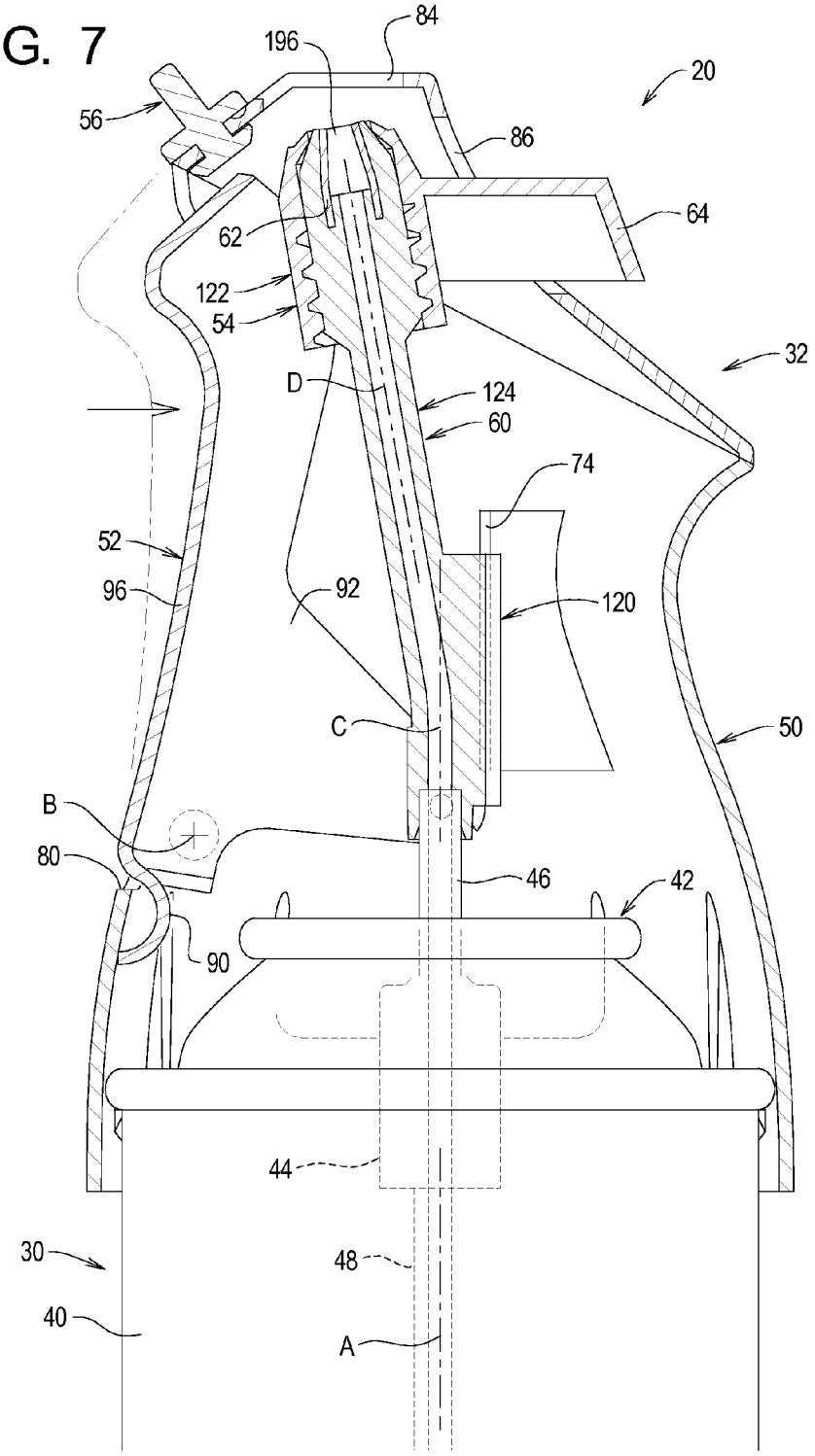
FIG. 7 is a side elevation, vertical, partial cutaway view of an example actuator assembly of the first example aerosol dispensing system in an open configuration.

The valve stem 46 and the actuator housing 50 support the outlet assembly 54 for movement relative to the container assembly 30 and the actuator housing 50 such that outlet assembly 54 moves along a container axis A between a first position as shown in FIG. 3 and a second position as shown in FIG. 7. In turn, the outlet assembly 54 engages the valve stem 46 such that valve assembly 44 is in the closed configuration when the outlet assembly 54 is in the first position and is in the open configuration when the outlet assembly 54 is in the second position. The example valve assembly 44 is configured to bias the valve stem 46 such that the outlet assembly 54 is normally in the first position.

With the foregoing general discussion of the construction and operation of the first example aerosol dispensing system 20 in mind, the construction and operation of the first example aerosol dispensing system 20, and in particular the actuator assembly 32 thereof, will now be described in detail.

Referring initially to the actuator housing 50, FIGS. 3 and 7 illustrate that the example actuator housing 50 comprises a skirt portion 70, a handle portion 72, first and second rail portions 74, one or more interference portions 76, and one or more skirt ribs 78. The actuator housing 50 further defines a trigger opening 80, one or more pivot openings 82, an outlet opening 84, an adjustment opening 86, and a lock opening 88.

The skirt portion 70 is sized and dimensioned to be snugly received over a cap rim 42*a* defined by the cap assembly 42. With the skirt portion 70 extending over the cap rim 42*a*, the interference portion(s) 76 engage and are arranged on a first side of the cap rim 42*a* and the skirt rib(s) 78 engage and are arranged on a second side of the cap rim 42*a* to secure the actuator housing 50 in a desired configuration relative to the container assembly 30. The example actuator housing 50 is made of plastic or other rigid but resiliently deformable material that allows the interference portion(s) 76 to be pressed over the cap rim 42*a* to detachably attach the actuator housing 50 to the container assembly 30 as shown in FIGS. 1, 3, 6, and 7.

The example handle portion 72 is sized and dimensioned to be gripped by a typical adult human hand. The trigger member 52 is movably supported within the trigger opening 80 relative to the actuator housing 50 as will be described in further detail below. At least one, and typically two or three, of the fingers of a hand gripping the handle portion 72 will be in position to displace the trigger member 52 relative to the actuator housing 50 when that hand is gripping the handle portion 72.

The first and second rail portions 74 extend inwardly from the actuator housing 50 to support the outlet assembly 54 for movement between the first and second positions as will be described in further detail below.

FIGS. 3, 4, 6, and 7 illustrate that the example trigger member 52 comprises a spring portion 90, first and second ear portions 92 each defining an ear notch 94, a finger portion 96, and one or more pivot portions 98.

Figure 6:
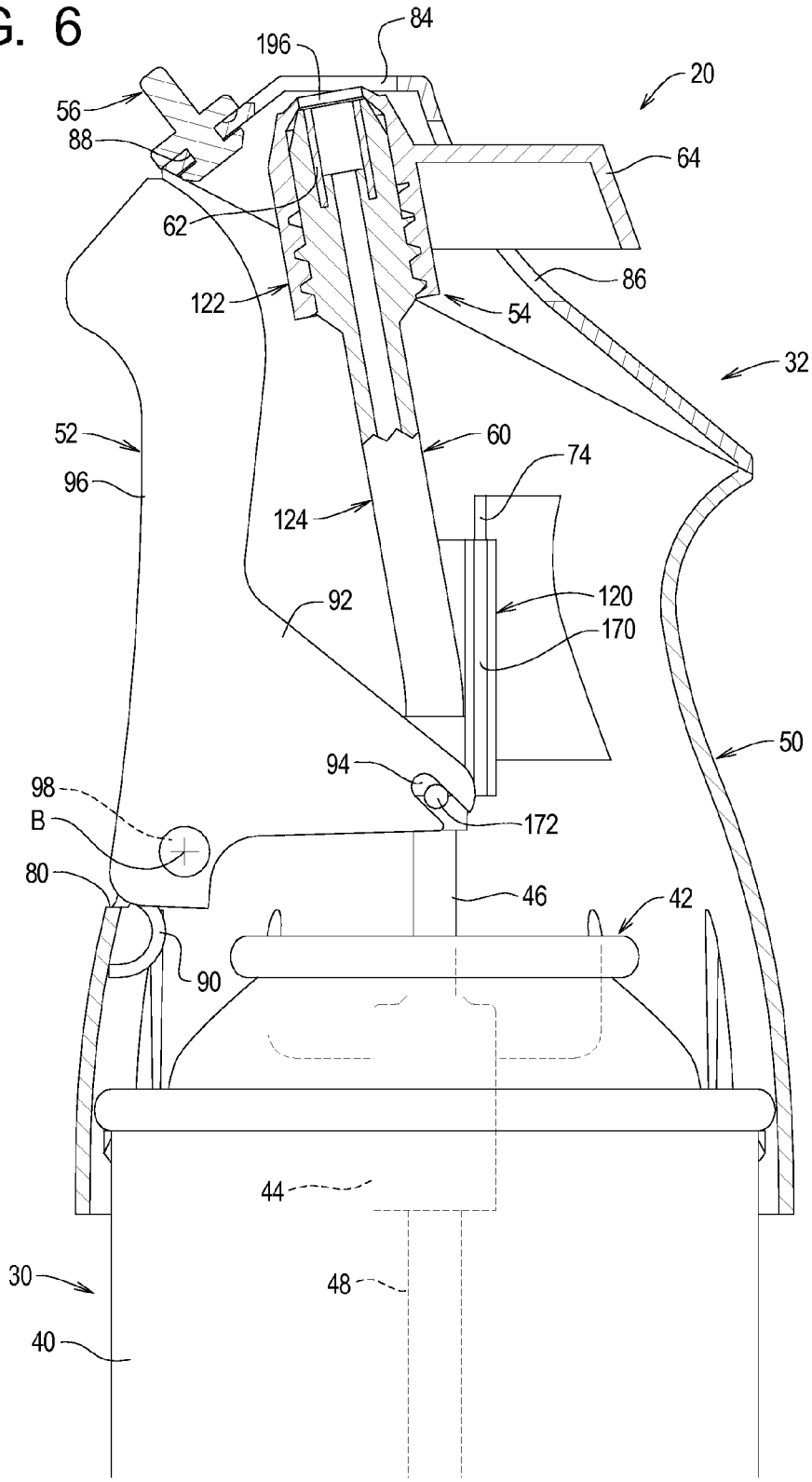
FIG. 6 is a side elevation view of the example actuator assembly of the first example aerosol dispensing system in which portions of an actuator housing, outlet assembly, and lock member have been cutaway.

The pivot portions 98 are sized and dimensioned to be received by the pivot openings 82 defined by the actuator housing 50. With the pivot portions 98 received by the pivot openings 82, the spring portion 90 of the trigger member 52 engages the actuator housing 50 to resiliently oppose rotation of the trigger member 52 about a trigger axis B from an unpressed position as depicted in FIGS. 3 and 6 to a pressed position as depicted in FIG. 7. The trigger axis B is spaced from and extends at substantially a right angle with respect to the container axis A. The spring portion 90 thus biases the trigger member 52 into the unpressed position but allows the deliberate application of manual force on the finger portion 96 to displace the trigger member 52 from the unpressed position to the pressed position.

The ear portions 92 extend from the finger portion 96 towards the outlet assembly 54. As will be described in further detail below, the finger portions 96 engage the outlet member 60 to move the outlet member 60 from the first position to the second position when the trigger member 52 is moved from the unpressed position to the pressed position.

FIGS. 3, 4, 6, and 7 further illustrate that the outlet member 60 defines a carriage portion 120, an adjustment portion 122, and a bridge portion 124. The carriage portion 120 defines a carriage axis C, and the adjustment portion 122 defines an outlet axis D. In the example actuator assembly 32, the carriage axis C is substantially aligned with the container axis A. The example outlet axis D extends at an angle of approximately 10 degrees with respect to the carriage axis B but this angle should in any event be within a first range of approximately 0 to 20 degrees or in a second range of approximately 0 to 30 degrees.

A feed passageway 130 extends through the outlet member 60 between a proximal opening 132 defined by the carriage portion 120 and a distal opening 134 defined by the adjustment portion 122. The feed passageway 130 further defines a proximal chamber portion 136 at the inlet opening 132 and a distal chamber portion 138 at the outlet opening 134. An internal passageway surface 140 of the outlet member 60 defines the feed passageway 130. The proximal chamber portion 136 of the feed passageway 130 is defined by an inlet surface 150, inlet shoulder 152, and an inlet edge 154 of the passageway surface 140.

The adjustment portion 122 of the outlet member 60 defines a threaded outer surface 160, one or more fingers 162, and a nipple 164. At least one finger slit 166 is formed in the example adjustment portion 122, and a mounting groove 168 is formed in the outlet member 60 around the nipple 164.

Figure 4:
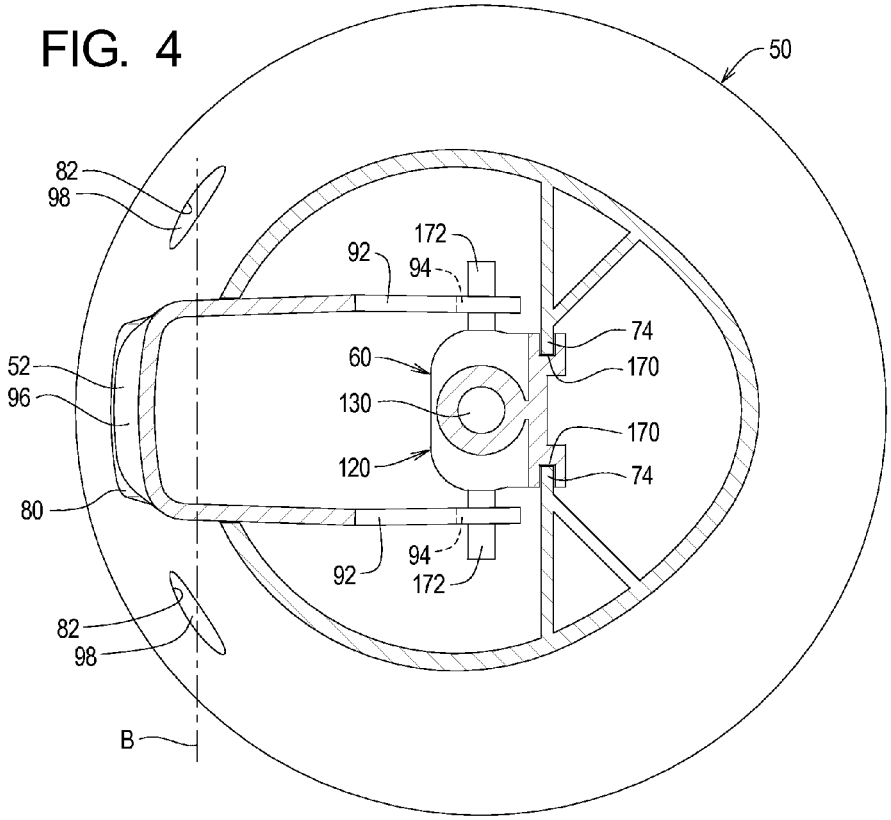
FIG. 4 is a horizontal cutaway view depicting details of a portion of the example actuator assembly of the first example aerosol dispensing system.
Figure 5:
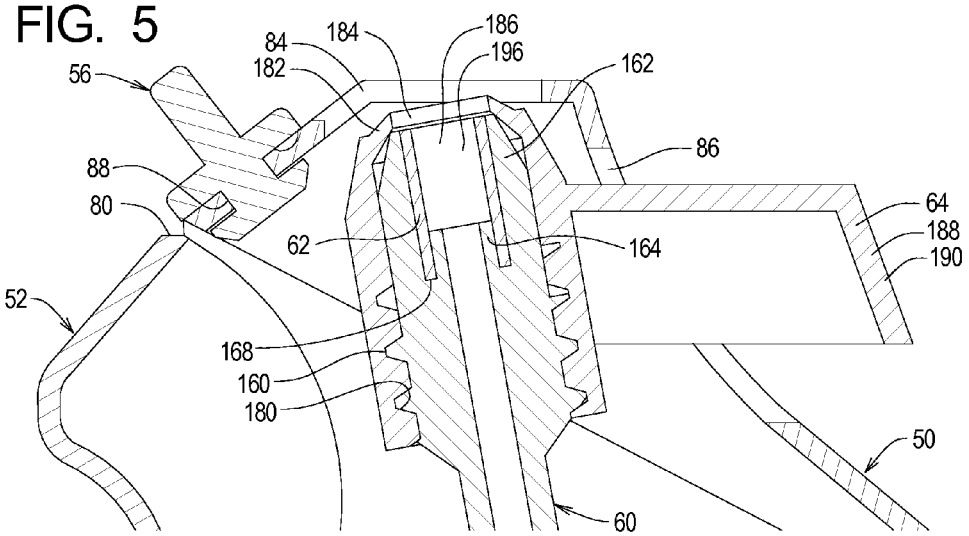
FIG. 5 is a vertical section view similar to FIG. 3 illustrating a portion of the example actuator assembly of the first example aerosol dispensing system.

The example outlet member 60 further defines one or more carriage slots 170 and one or more carriage projections 172. The example carriage slots 170 are formed in opposite sides of the carriage portion 120 of the outlet member 60, and the example carriage projections 172 extend from opposite sides of the carriage portion 120 of the outlet member 60. As perhaps best shown in FIG. 4, the carriage slots 170 are sized and dimensioned to receive the rail portions 74 of the actuator housing 50 to guide the outlet member 60 for linear movement between the first and second positions. FIGS. 4 and 6 illustrate that the ear notches 94 formed in the ear portions 92 of the trigger member 52 receive the carriage projections 172 such that movement of the ear portions 92 is translated into movement of the example outlet member 60. Accordingly, depressing the trigger member 52 from the unpressed position to the pressed position causes movement of the outlet member 60 from the first position to the second position.

Turning now to FIGS. 3, 5, 6, and 7, it can be seen that the adjustment member 122 defines a threaded inner surface 180 and an engaging surface 182. The example outlet member 60 further defines an adjustment passageway 184 and a through opening 186. An adjustment handle 188 extends from the adjustment member 122. The resilient member 62 is a hollow tube made of resilient material sized and dimensioned to be held within the distal chamber 138 of the outlet member 60 by extending into the groove 168 and frictionally engaging the nipple 164.

To assemble the aerosol dispensing system 20, the outlet member 60, resilient member 62, and adjustment member 64 are initially combined to form the outlet assembly 54. In particular, the resilient member 62 is arranged such that one end thereof is received within the groove 168 in the distal chamber 138 and the nipple 164 is arranged within the outlet member 62. The adjustment member 64 is then displaced such that the threaded inner surface 180 thereof engages the threaded outer surface 160 formed on the adjustment portion 122 of the outlet member 60. Rotating the adjustment member 64 relative to the outlet member causes the threaded surfaces 180 and 160 to engage each other such that the outlet member 60 is displaced along the outlet axis D defined by the adjustment portion 122 of the outlet member 60. As shown by a comparison of FIGS. 3 and 6 with FIG. 7, rotation of the adjustment member 64 relative to the outlet member 60 deforms the resilient member 62 to reduce a cross-sectional area of an outlet opening 196 defined by the resilient member 62. As will be described in further detail below, a pitch of the threaded surfaces 160 and 180 is selected to determine a size of the cross-sectional area of the outlet opening 196 in a fully open configuration as shown in FIGS. 3 and 6 and in a fully restricted configuration as shown in FIG. 7. The use of the threaded surfaces 160 and 180 allows the cross-sectional area of the outlet opening 196 to be continuously varied between the fully open configuration and the fully restricted configuration.

The actuator housing 50, trigger member 52, and outlet assembly 54 are then combined to form the actuator assembly 32. In particular, the trigger member 52 is initially arranged such that the spring portion 90 engages the actuator housing 50 adjacent to the trigger opening 80, the pivot portions 98 are arranged within the pivot openings 82, and the finger portion 96 is arranged within the trigger opening 80. At this point, the outlet assembly 54 is displaced such that the rail portions 74 of the actuator housing are received by the carriage slots 170 in the carriage portion 120 of the outlet member 60. Further displacement of the outlet assembly 54 causes the carriage projections 172 to enter the ear notches 94, the outlet opening 196 to be arranged adjacent to the outlet opening 84, and the handle portion 190 to extend through the adjustment opening 86.

If the optional lock member 56 is used, the lock member 56 is also arranged within the lock opening 88 such that the lock portion 192 is within the actuator housing 50 and the handle portion 190 is outside of the actuator housing 50. When rotated into a locked position as shown in FIG. 3, the lock portion 192 of the lock member 56 prevents movement of the trigger member 52 from the unpressed position to the pressed position. When rotated into an unlocked position as shown in FIGS. 6 and 7, the lock member 56 does not interfere with movement of the trigger member between the unpressed and pressed positions. In the locked position, then, the lock member 56 prevents inadvertent displacement of the trigger member 52 and thus operation of the aerosol dispensing system 20.

A typical texture material 34 forming at least a part of the texture coating 22 may comprise a base or carrier, a binder, a filler, and, optionally, one or more additives such as surfactants, biocides and thickeners. Examples of the base or carrier include water, solvent (oil-based texture material) such as xylene, toluene, acetone, methyl ethyl ketone, and combinations of water and water soluble solvents. Examples of binders include starch, polyvinyl alcohol and latex resins (water-based systems) and a wide variety of polymers such as ethylene vinyl acetate, thermoplastic acrylics, styrenated alkyds, etc. (solvent-based systems.). Examples of fillers include calcium carbonate, titanium dioxide, attapulgite clay, talc, magnesium aluminum silicate, etc.

The propellant material 36 may comprise a liquid phase propellant material, and the pressurized material will typically comprise a gas phase propellant material. The following propellant materials are appropriate for use as the propellant material forming the stored material 34 and the pressurized material 36: dimethyl ether, propane, butane, isobutene, difluoroethane, and tetrafluoroethane.

The following Tables A-1, A-2, and A-3 and Tables A-4 and A-5 attached hereto as Exhibit A contain example formulations of the texture material 34 that may be used to form part of the texture coating of the first example aerosol dispensing system 20.

TABLE A-1

(Solvent Based)

| Material | Purpose | First Example | Second Example | Third Example |
|---|---|---|---|---|
| Solvent | Base | 35% | 30-40% | 20-60% |
| Pigment | Filler | 60% | 55-65% | 40-80% |
| Resin | Binder | 2.5% | 0-5% | 0-15% |

To the example texture material described in Table A-1 is added propellant material 36 in the form of a propane/butane/isobutane blend. A first range of approximately 10-20% by weight of the propellant material is added to the example texture material of Table A-1, but the propellant material should in any event be within a second range of approximately 5-25% by weight of the propellant material.

TABLE A-2

(Knockdown)

| Material | Purpose | First Example | Second Example | Third Example |
|---|---|---|---|---|
| Water | Base | 48% | 45-55% | 40-60% |
| Pigment | Filler | 50% | 45-55% | 40-60% |
| Resin | Binder | 2% | 0-5% | 0-10% |

To the example texture material described in Table A-2 is added propellant material in the form of DME. A first range of approximately 7-15% by weight of the propellant material is added to the example texture material of Table A-2, but the propellant material should in any event be within a second range of approximately 5-25% by weight of the propellant material.

TABLE A-3

(No Prime)

| Material | Purpose | First Example | Second Example | Third Example |
|---|---|---|---|---|
| Water | Base | 42% | 40-50% | 30-60% |
| Pigment | Filler | 47% | 40-50% | 30-60% |
| Resin | Binder | 10% | 5-15% | 0-20% |

To the example texture material described in Table A-3 is added propellant material in the form of DME. A first range of approximately 10-15% by weight of the propellant material is added to the example texture material of Table A-3, but the propellant material should in any event be within a second range of approximately 5-25% by weight of the propellant material.

With reference to Tables A-4 and A-5 in Exhibit A, those tables contain examples of texture material composition adapted to be combined with an aerosol and dispensed using an aerosol dispensing system in accordance with the principles of the present invention. Each value or range of values in Tables A-4 and A-5 represents the percentage of the overall weight of the example texture material composition formed by each material of the texture material composition for a specific example, a first example range, and a second example range. The composition described in Table A-5 is similar to that of Table A-4, but Table A-5 contains a number of additional materials that may optionally be added to the example texture material composition of Table A-4.

One example of a method of combining the materials set forth in Table A-4 is as follows. Materials A, B, C, and D are combined to form a first sub-composition. The first sub-composition is mixed until material D is dissolved (e.g., 30-40 minutes). Materials E and F are then added to the first sub-composition to form a second sub-composition. The second sub-composition is mixed until materials E and F are well-dispersed (e.g., at high speed for 15-20 minutes). Material G is then added to the second sub-composition to form a third sub-composition. The third sub-composition is mixed well (e.g., 10 minutes). Typically, the speed at which the third sub-composition is mixed is reduced relative to the speed at which the second sub-composition is mixed. Next, materials H, I, and J are added to the third sub-composition to form the example texture material composition of the present invention. The example texture material composition is agitated. Material K may be added as necessary to adjust (e.g., reduce) the viscosity of the example texture material composition.

The example texture material composition of the present invention may be combined with an aerosol propellant in any of the aerosol dispensing systems described herein to facilitate application of the example texture material composition to a surface to be textured.

From the foregoing, it should be apparent that the present invention may be embodied in forms other than those specifically discussed above. The scope of the present invention should thus be determined by the claims appended hereto and not the foregoing detailed description of examples of the invention.

Exhibit A

TABLE A-4

| Ref. | Material | Commercial Example | Function/Description | Example | First Range | Second Range |
|---|---|---|---|---|---|---|
| A | Diacetone alcohol | | Medium-evaporating, low odor solvent | 3.85 | 3.85 ± 5% | 3.85 ± 10% |
| B | Propylene Carbonate | | Slow evaporating, low odor solvent | 2.31 | 2.31 ± 5% | 2.31 ± 10% |
| C | Denatured Ethanol | PM 6193-200 | Fast evaporating, low odor solvent | 13.33 | 13.33 ± 5% | 13.33 ± 10% |
| D | Resin | TB-044 resin (Dai) | Acrylic resin/binder (soluble in "weak" solvents) | 4.93 | 4.93 ± 5% | 4.93 ± 10% |
| E | Clay Pigment | Bentone 34 | Anti-settle/anti-sag clay pigment | 1.26 | 1.26 ± 5% | 1.26 ± 10% |
| F | Fumed | Aerosil R972 | Anti-settle fumed silica | 0.08 | 0.08 ± 5% | 0.08 ± 10% |

TABLE A-4-continued

| Ref. | Material | Commercial Example | Function/Description | Example | First Range | Second Range |
|---|---|---|---|---|---|---|
| | Silica | | | | | |
| G | Dispersant | Byk Anti-Terra 204 | Dispersing aid | 0.51 | 0.51 ± 5% | 0.51 ± 10% |
| H | Calcium carbonate | MarbleWhite 200 (Specialty Minerals) | filler/extender | 33.87 | 33.87 ± 5% | 33.87 ± 10% |
| I | Nepheline syenite | Minex 4 | filler/extender | 33.87 | 33.87 ± 5% | 33.87 ± 10% |
| J | Denatured Ethanol | PM 6193-200 | Fast evaporating, low odor solvent | 4.00 | 4.00 ± 5% | 4.00 ± 10% |
| K | Denatured Ethanol | PM 6193-200 | Fast evaporating, low odor solvent | 1.99 | 1.99 ± 5% | 1.99 ± 10% |
| | | | | 100 | | |

TABLE A-5

| Ref. | Material | Commercial Example | Function/Description | Example | First Range | Second Range |
|---|---|---|---|---|---|---|
| A | Diacetone alcohol | | Medium-evaporating, low odor solvent | 13.73 | 5-15% | 0-20% |
| B | Propylene Carbonate | | Slow evaporating, low odor solvent | 2.11 | 1-3% | 0-5% |
| C | Denatured Ethanol | PM 6193-200 | Fast evaporating, low odor solvent | 10.56 | 5-15% | 0-20% |
| D | Resin | TB-044 resin (Dai) | Acrylic resin/binder (soluble in "weak" solvents) | 4.93 | 2-6% | 1-10% |
| E | Clay Pigment | Bentone 34 | Anti-settle/anti-sag clay pigment | 1.26 | 0.5-1.5% | 0.1-2.0% |
| F | Fumed Silica | Aerosil R972 | Anti-settle fumed silica | 0.08 | 0-0.20% | 0-0.50% |
| G | Dispersant | Byk Anti-Terra 204 | Dispersing aid | 0.51 | 0.3-0.7% | 0.1-1.5% |
| H | Calcium carbonate | MarbleWhite 200 (Specialty Minerals) | filler/extender | 33.87 | 20-40% | 0-70% |
| I | Nepheline syenite | Minex 4 | filler/extender | 33.87 | 20-40% | 0-70% |
| J | Titanium Dioxide | | White pigment | 0.00 | 0-5% | 0-20% |
| K | Calcined clay | Optiwhite | White extender pigment | 0.00 | 0-10% | 0-20% |
| | | | | 100 | | |
| L | Hexane | | Very fast evaporating, low odor solvent | 0.00 | 0-10% | 0-20% |

What is claimed is:

1. An aerosol dispensing system for dispensing texture material onto a ceiling surface, comprising:

a container assembly comprising a valve assembly operable in a closed configuration and a fully open configuration; and an actuator assembly comprising an actuator housing defining at least one rail portion, a trigger member pivotably attached to the actuator housing, and an outlet assembly defining an outlet opening, where the outlet assembly is slidably supported relative to the actuator housing by the at least one rail portion, whereby the trigger member engages the outlet assembly such that application of deliberate manual force on the trigger member causes pivoting movement of the trigger member relative to the actuator housing, and pivoting movement of the trigger member relative to the actuator housing causes linear movement of the outlet assembly relative to the actuator housing; and the outlet assembly engages the valve assembly such that linear movement of the outlet assembly alters the valve assembly from the closed configuration to the fully open configuration.

2. An aerosol dispensing system as recited in claim 1, in which:

the trigger member moves between an unpressed position in which the valve assembly is in the closed configuration and a pressed position in which the valve assembly is in the fully open configuration; and the trigger member defines a finger portion, where the finger portion is substantially vertical when the aerosol dispensing system is in a substantially vertical orientation, and the trigger member is in the unpressed position.

3. An aerosol dispensing system as recited in claim 1, in which:

the container assembly defines a container axis;

the trigger member moves between an unpressed position in which the valve assembly is in the closed configuration and a pressed position in which the valve assembly is in the fully open configuration; and the trigger member defines a finger portion, where the finger portion is substantially parallel to the container axis when the trigger member is in the unpressed position, and the finger portion is angled with respect to the container axis when the trigger member is in the pressed position.

4. An aerosol dispensing system as recited in claim 1, in which:

the trigger member moves between an unpressed position in which the valve assembly is in the closed configuration and a pressed position in which the valve assembly is in the fully open configuration; and the trigger member defines a spring portion, where the spring portion engages the trigger member to bias the trigger member into the unpressed position.

5. An aerosol dispensing system as recited in claim 1, in which the trigger member defines at least one ear portion, where the ear portion engages the actuator assembly such that pivoting movement of the trigger member relative to the actuator housing displaces the outlet assembly relative to the actuator housing.

6. An aerosol dispensing system as recited in claim 5, in which the trigger member defines at least one ear portion, where the ear portion engages the actuator assembly such that pivoting movement of the trigger member relative to the actuator housing displaces the outlet assembly relative to the actuator housing.

7. An aerosol dispensing system as recited in claim 1, in which: the trigger member moves between an unpressed position in which the valve assembly is in the closed configuration and a pressed position in which the valve assembly is in the fully open configuration; and the trigger member defines a spring portion, where the spring portion engages the trigger member to bias the trigger member into the unpressed position, a finger portion, where application of deliberate manual force on the finger portion displaces the trigger member from the unpressed position to the pressed position against the bias of the spring portion.

8. An aerosol dispensing system as recited in claim 1, in which the outlet assembly comprises:

an outlet member defining the outlet opening;

a resilient member supported by the outlet member; and an adjustment member supported by the resilient member such that movement of the adjustment member relative to the outlet member alters a cross-sectional area of the outlet member.

9. An aerosol dispensing system as recited in claim 8, in which the outlet member defines an outlet passageway that allows fluid to flow between the valve assembly and the outlet opening.

10. An aerosol dispensing system as recited in claim 1, in which the outlet member defines at least one carriage slot, where the at least one carriage slot engages the at least one rail portion to guide the outlet member for movement between the first and second positions relative to the housing member, wherein:

the valve assembly is in the closed configuration when the outlet member is in the first position; and the valve assembly is in the fully open configuration when the outlet member is in the second position.

11. An aerosol dispensing system as recited in claim 10, in which: the housing member defines first and second rail portions; and the outlet member defines first and second carriage slots; whereby the first and second carriage slots receive the first and second rail portions, respectively, to guide the outlet member for movement between the first and second positions relative to the housing member.

12. An aerosol dispensing system as recited in claim 11, in which:

the first and second rail portions inwardly extend from the housing member; and the first and second carriage slots outwardly extend from the outlet member.

13. An aerosol dispensing system for dispensing texture material onto a ceiling surface, comprising:

a container assembly comprising a valve assembly operable in a closed configuration and a fully open configuration, where the aerosol assembly contains the texture material and a propellant material; and an actuator assembly comprising an actuator housing defining at least one rail portion, a trigger member pivotably attached to the actuator housing, and an outlet assembly defining an outlet opening, where the outlet assembly is slidably supported relative to the actuator housing by the at least one rail portion, whereby the trigger member engages the outlet assembly such that application of deliberate manual force on the trigger member causes pivoting movement of the trigger member relative to the actuator housing, and pivoting movement of the trigger member relative to the actuator housing causes linear movement of the outlet assembly relative to the actuator housing;

the outlet assembly engages the valve assembly such that linear movement of the outlet assembly alters the valve assembly from the closed configuration to the fully open configuration; and the propellant material threes the texture material out of the outlet opening when the valve assembly is not in the closed configuration.

14. An aerosol dispensing system as recited in claim 13, in which:

the trigger member moves between an unpressed position in which the valve assembly is in the closed configuration and a pressed position in which the valve assembly is in the fully open configuration; and the trigger member defines a finger portion, where the finger portion is substantially vertical when the aerosol dispensing system is in a substantially vertical orientation, and the trigger member is in the unpressed position.

15. An aerosol dispensing system as recited in claim 13, in which:

the container assembly defines a container axis;

the trigger member moves between an unpressed position in which the valve assembly is in the closed configuration and a pressed position in which the valve assembly is in the fully open configuration; and the trigger member defines a finger portion, where the finger portion is substantially parallel to the container axis when the trigger member is in the unpressed position, and the finger portion is angled with respect to the container axis when the trigger member is in the pressed position.

16. An aerosol dispensing system as recited in claim 13, in which:

the trigger member moves between an unpressed position in which the valve assembly is in the closed configuration and a pressed position in which the valve assembly is in the fully open configuration; and the trigger member defines a spring portion, where the spring portion engages the trigger member to bias the trigger member into the unpressed position.

17. An aerosol dispensing system as recited in claim 13, in which the trigger member defines at least one ear portion, where the ear portion engages the actuator assembly such that pivoting movement of the trigger member relative to the actuator housing displaces the outlet assembly relative to the actuator housing.

18. An aerosol dispensing system as recited in claim 17, in which the trigger member defines at least one ear portion, where the ear portion engages the actuator assembly such that pivoting movement of the trigger member relative to the actuator housing displaces the outlet assembly relative to the actuator housing.

19. An aerosol dispensing system as recited in claim 13, in which:

the trigger member moves between an unpressed position in which the valve assembly is in the closed configuration and a pressed position in which the valve assembly is in the fully open configuration; and the trigger member defines a spring portion, where the spring portion engages the trigger member to bias the trigger member into the unpressed position, a finger portion, where application of deliberate manual force on the finger portion displaces the trigger member from the unpressed position to the pressed position against the bias of the spring portion.

20. An aerosol dispensing system as recited in claim 13, in which the outlet assembly comprises:

an outlet member defining the outlet opening;

a resilient member supported by the outlet member; and an adjustment member supported by the resilient member such that movement of the adjustment member relative to the outlet member alters a cross-sectional area of the outlet member.

21. An aerosol dispensing system as recited in claim 20, in which the outlet member defines an outlet passageway that allows fluid to flow between the valve assembly and the outlet opening.

22. An aerosol dispensing system as recited in claim 13, in which the outlet member defines at least one carriage slot, where the at least one carriage slot engages the at least one rail portion to guide the outlet member for movement between the first and second positions relative to the housing member, wherein:

the valve assembly is in the closed configuration when the outlet member is in the first position; and the valve assembly is in the fully open configuration when the outlet member is in the second position.

23. An aerosol dispensing system as recited in claim 22, in which:

the housing member defines first and second rail portions; and the outlet member defines first and second carriage slots; whereby the first and second carriage slots receive the first and second rail portions, respectively, to guide the outlet member for movement between the first and second positions relative to the housing member.

24. An aerosol dispensing system as recited in claim 23, in which: the first and second rail portions inwardly extend from the housing member; and the first and second carriage slots outwardly extend from the outlet member.

* * * * *